US006969325B1

(12) United States Patent
Harrelson

(10) Patent No.: US 6,969,325 B1
(45) Date of Patent: Nov. 29, 2005

(54) GOLF CLUB, A METHOD FOR REDUCING THE DRAG EXPERIENCED BY A GOLF CLUB, AND A GOLF CLUB FORMED BY A NEW AND NOVEL PROCESS WHICH REDUCES DRAG AS THE GOLF CLUB IS UTILIZED

(76) Inventor: David Harrelson, 4806 Malibu Dr., Bloomfield Hills, MI (US) 48302

( * ) Notice: Subject to any disclaimer, the term of this patent is extended or adjusted under 35 U.S.C. 154(b) by 0 days.

(21) Appl. No.: 10/813,422

(22) Filed: Mar. 30, 2004

(51) Int. Cl.[7] ..... A63B 53/04

(52) U.S. Cl. ..... 473/327; 473/328

(58) Field of Search ..... 473/327, 328, 473/349, 350; D21/751–753, 743

(56) References Cited

U.S. PATENT DOCUMENTS

| | | | | | |
|---|---|---|---|---|---|
| 780,776 | A * | 1/1905 | Brown | 473/327 |
| D212,293 | S * | 9/1968 | Brown | D21/751 |
| 3,719,359 | A * | 3/1973 | Evans et al. | 473/328 |
| 4,869,508 | A * | 9/1989 | Miller | 473/328 |
| 5,000,455 | A * | 3/1991 | Beilfuss, Sr. | 473/328 |
| 6,471,602 | B1 * | 10/2002 | D'Orazio | 473/324 |
| 6,517,449 | B2 * | 2/2003 | Otoguro | 473/328 |

* cited by examiner

*Primary Examiner*—Sebastiano Passaniti
(74) *Attorney, Agent, or Firm*—Law Offices of John Chupa & Associates, P.C.

(57) ABSTRACT

A new and novel golf club 10 having a handle portion 12 and a golf ball contacting portion 16 which includes at least one aperture or slot 30 which reduces the drag experienced by the golf club 10 as it hits a golf ball 70.

1 Claim, 3 Drawing Sheets

GOLF CLUB, A METHOD FOR REDUCING THE DRAG EXPERIENCED BY A GOLF CLUB, AND A GOLF CLUB FORMED BY A NEW AND NOVEL PROCESS WHICH REDUCES DRAG AS THE GOLF CLUB IS UTILIZED

FIELD OF THE INVENTION

The present invention generally relates to a golf club which is formed by a new and novel process and to a method for reducing the drag experienced by a golf club as it is utilized and, more particularly, to a golf club having a ball contacting surface and/or a portion which has at least one opening of a desired size and shape and which is effective to generally reduce drag as the golf club is utilized.

BACKGROUND OF THE INVENTION

A golf club generally includes a shaft portion having a handle or grip portion which is grasped in the hands of a golfer and a ball contacting portion which is attached to the shaft portion and which is used to selectively contact a golf ball in order to attempt place it in a desired position upon a golf course. Particularly, as should be appreciated by one of ordinary skill in the art, different types of golf clubs exist which are adapted to be used in various "play situations" during a round of golf.

That is, the conventional or traditional golf clubs vary by the type of material used to construct the respective shaft portion (e.g., graphite) and the pitch and material used to construct the ball contacting portion (e.g., wedges have a golf ball contacting portion having a greater loft or pitch than the golf ball contacting portion of a driver).

While there does exist a variety of different types of golf clubs, they all suffer from the disadvantage of experiencing drag upon their impact with sand, grass, or other objects before they respectively and actually contact the targeted golf ball. Such drag undesirably reduces the energy which is imparted upon the golf ball and decreases accuracy. Large levels of such undesirable drag is often experienced by wedge clubs which are often used in tall grass (e.g., known as "rough") and sand situations.

There is therefore a need for a new and improved golf club which experiences reduced levels of drag and which allows higher amounts of energy to be imparted to a golf ball and which further allows the golf ball to be placed in an accurate manner upon a golf course. As seen below, the present inventions allow these needs to be addressed in a new and novel fashion.

SUMMARY OF THE INVENTION

It is a first non-limiting object of the present invention to provide a new and novel golf club.

It is a second non-limiting object of the present invention to provide a method for producing a new and novel golf club.

It is a third non-limiting object of the present invention to provide a new and novel golf club which is made by and new and novel process.

It is a fourth non-limiting object of the present invention to provide a golf club which experiences significantly lower amounts of drag than conventional golf clubs.

According to a first non-limiting aspect of the present invention, a golf club is provided. Particularly, the provided golf club includes a golf ball contacting portion, wherein the golf ball contacting portion includes at least one opening disposed therein.

According to a second non-limiting aspect of the present invention, a golf club is provided. Particularly, the golf club includes a golf ball contacting portion, wherein said golf ball contacting portion includes at least one slotted aperture.

According to a third non-limiting aspect of the present invention, a golf club is provided. Particularly, the provided golf club includes a golf ball contacting portion, wherein said golf ball contacting portion includes at least one slot.

According to a fourth non-limiting aspect of the present invention, a golf club is provided. Particularly, the provided golf club includes a golf ball contacting portion, wherein the golf ball contacting portion includes a plurality of substantially identical and equally spaced slots.

According to a fifth non-limiting aspect of the present invention, a golf club is provided. Particularly, the provided golf club includes a shaft; and a golf ball contacting portion which is coupled to the shaft, wherein the golf ball contacting portion includes a plurality of substantially identical and equally spaced slots and wherein each of the substantially identical and equally spaced slots have a respective longitudinal axis of symmetry and wherein each of the longitudinal axes of symmetry are longitudinal coextensive to each other.

According to a sixth non-limiting aspect of the present invention, a method for reducing the drag experienced by a golf club of the type having a ball contacting surface, is provided. Particularly, the provided method includes the step of forming at least one slot within the ball contacting surface.

According to a seventh non-limiting aspect of the present invention, a method for reducing the drag experienced by a golf club of the type having a ball contacting surface, is provided. Particularly, the method includes the step of forming a plurality of substantially identical and equally spaced slots within the ball contacting surface.

According to an eighth non-limiting aspect of the present invention, a golf club is provided. Particularly, the provided golf club is made by the process of forming a shaft portion; forming a ball contacting portion; forming at least on slot within the ball contacting portion; and attaching the ball contacting portion to the shaft portion.

These and other features, aspects, and advantages of the present inventions will become apparent from a reading of the following detailed description of the preferred embodiment of the inventions and by reference to the following drawings. It should be appreciated that the foregoing advantages and aspects are non-limiting in nature and are proffered for illustrative purposes only and not to limit the generality of the inventions in any manner whatsoever.

DETAILED DESCRIPTION OF THE PREFERRED EMBODIMENT OF THE INVENTION

Figure 1:
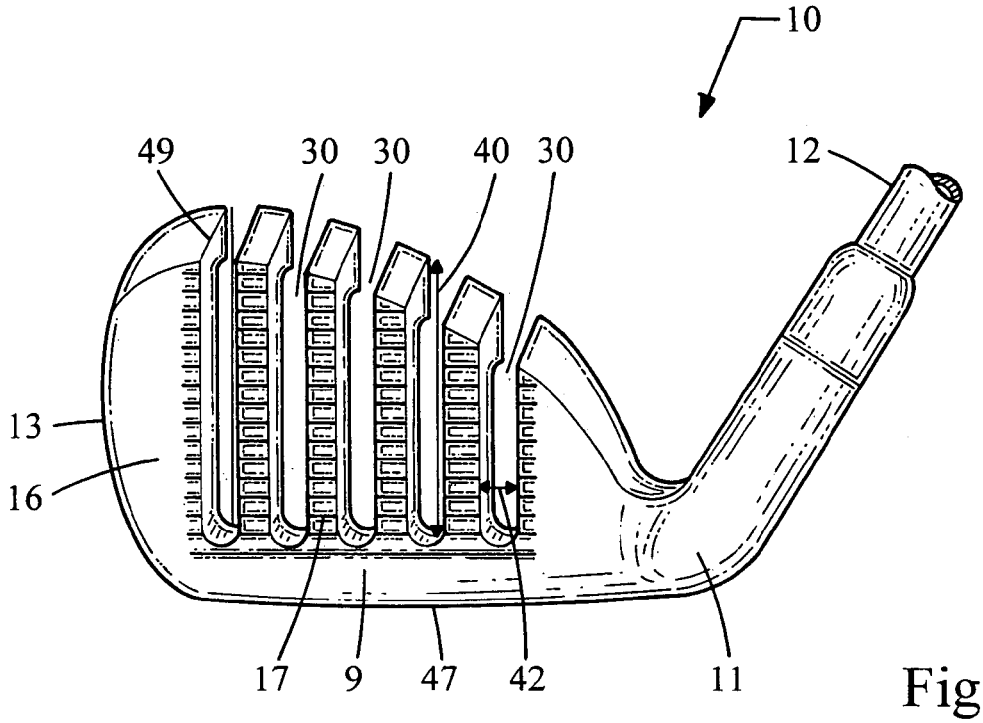
FIG. 1 is a partial front view of a golf club made in accordance with the teachings of the preferred embodiment of the inventions.
Figure 2:
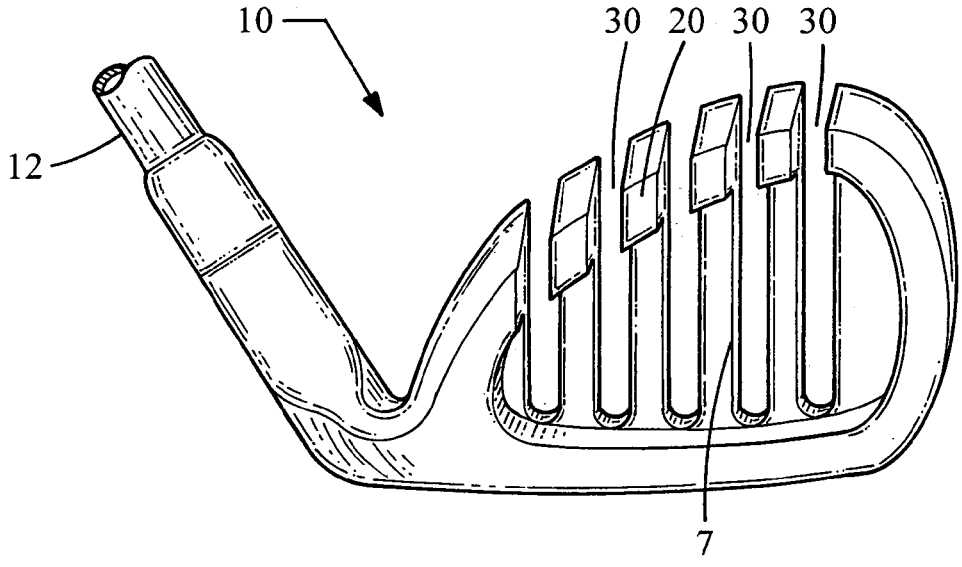
FIG. 2 is a partial back view of the golf club which is shown in FIG. 1.

Referring now to FIGS. 1 and 2, there is shown a golf club 10 which is made in accordance with the various teachings of the inventions.

Particularly, the golf club 10 includes a shaft portion 12 which is adapted to be selectively held by a user or a golfer and a golf ball contacting portion 16 which is selectively attached to the handle portion 12 during the manufacturing process of the golf club 10. Such attachment may be made, as should be appreciated by those of ordinary skill in the art, by the use of a welding attachment 16 or by any other conventional attachment mechanism. Alternatively, the golf club 10 may be molded into a "one piece" configuration in which the shaft portion 12 and the golf ball contacting portion 16 are formed in a single step within a mold or in a die by a casting process.

As should be apparent from the included drawings, the golf ball contacting portion 16 includes at least one opening or aperture of a desired shape, size, and spatial geometry. In a first non-limiting embodiment of the invention, as shown best in FIGS. 1 and 2, the golf ball contacting portion 16 includes at least one and typically several slotted openings 30, each having a respectively longitudinal axis of symmetry 40 and each of the longitudinal axes of symmetry 40 are longitudinally coextensive to each other and generally extend in the direction of the user of the golf club 10 (not shown). It should be appreciated that openings 30 may be of substantially any desired shape, size, or have any other desired spatial geometry that one may desire and that, in one non-limiting embodiment of the invention, the slotted openings 30 are substantially identical. However, in the most preferred embodiment of the invention, as is best shown in FIGS. 1 and 2, the longest slotted opening 30 resides nearest the end portion 13 of the golf ball contacting portion 16 and the shortest slotted opening 30 resides nearest the heel portion 11 of the golf club 10. The length of the remaining slotted openings 30 is respectively dependent upon their position within the golf club contacting portion 16 and, in this most preferred embodiment of the invention, the closest a slotted opening is to the heel portion 11, the shorter is its overall length. Further, in this one non-limited embodiment of the invention, each of the openings 30 has a substantially identical width 42 of about one-quarter of an inch to about one-half of an inch, although other dimensions may be used, and each of the slotted openings 30 terminates slightly above the heel or ground contacting portion 47 of the golf ball contacting portion 16, but through the opposed edge portion 49. The portions 17 which respectively lie between adjacent pairs of slotted openings 30 may have a desired finish or texture which is different from the texture or the finish of the remainder of the golf ball contacting portion 16. The portion 9 which lies below the slotted openings 30 may have a substantial identical texture and finish as the portion 17.

Figure 4:
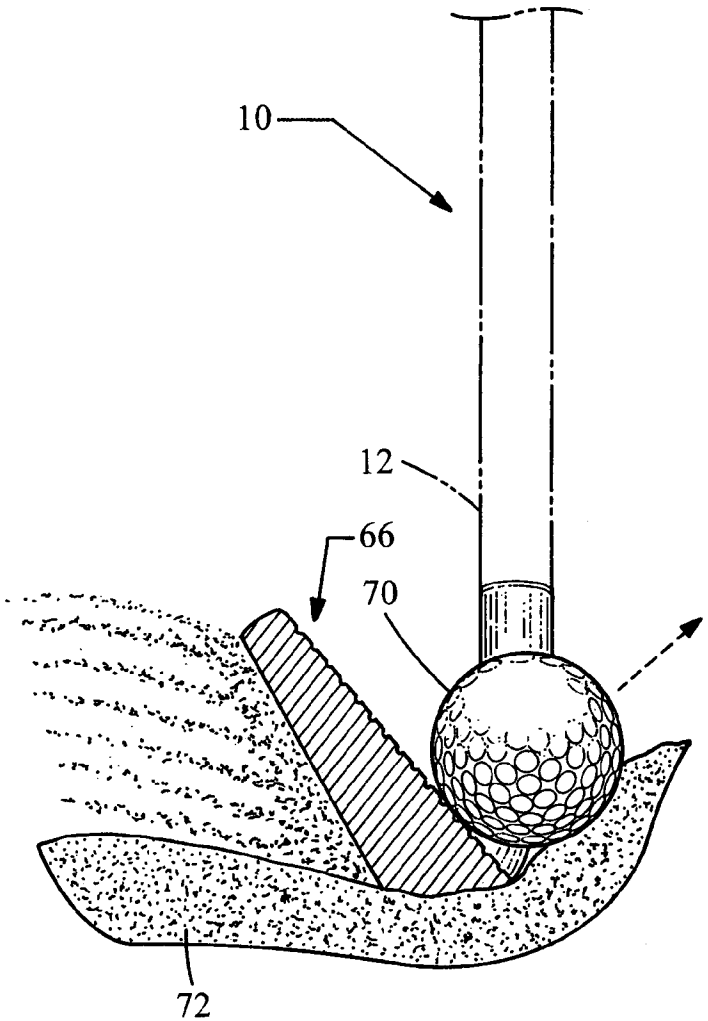
FIG. 4 is a diagrammatic view of the golf club which is shown in FIG. 6 selectively contacting the golf ball which is positioned in the manner which is shown in FIG. 6.
Figure 3:
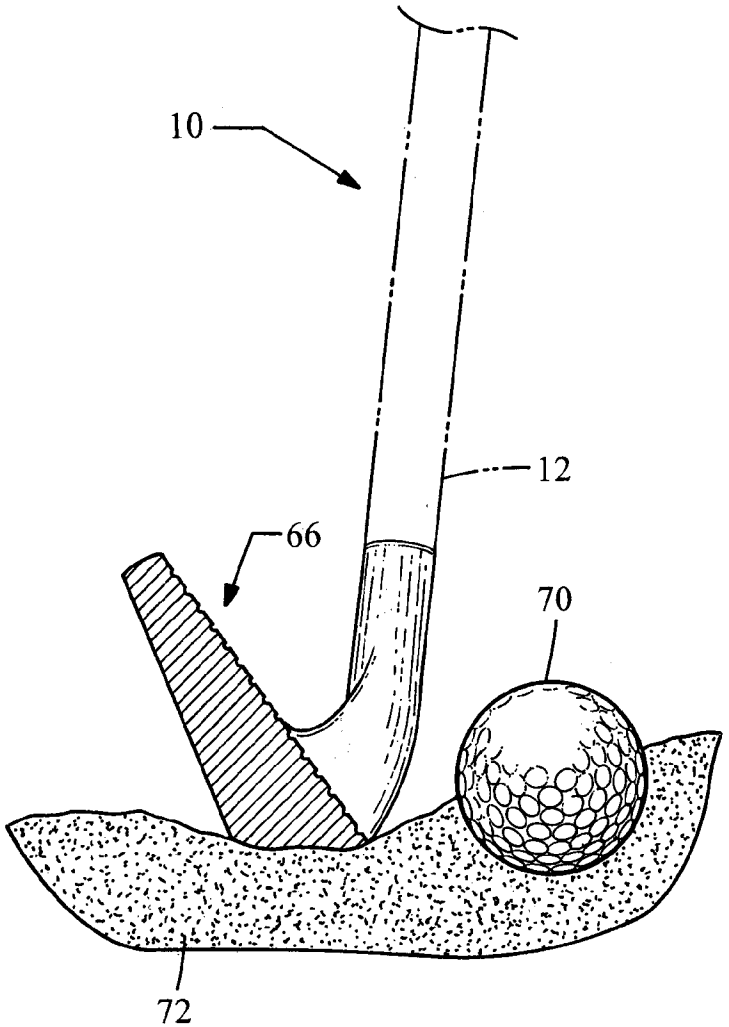
FIG. 3 is a side view of the golf club which is shown in FIGS. 1 and 2 addressing a golf ball which is positioned within a typical sand trap.

To understand the significance of the at least one opening 30, reference is now made to FIGS. 3 and 4. As shown, the golf ball 70 resides within sand 72 and the golf ball 70 is to be selectively struck by the golf club 10 (i.e., by the golf ball contacting portion 16 of the golf club 10). Particularly, as the golf ball contacting portion 16 selectively traverses the sand 72, at least a portion of the sand 72 "passes through" the at least one slot or aperture 30, thereby reducing the overall drag experienced by the golf club 10 and allowing a greater amount of energy to be actually imparted to the golf ball 70 and allowing for an accurate placement of the golf ball 70 upon the golf course. In the most preferred embodiment of the invention, the coextensive nature of the longitudinal axes of symmetry 40 efficiently allows the sand 72 (and other material) to "pass through" the golf ball contacting surface 16 and the substantially identical widths 42 allows equal amounts of such sand 72 (or other material) to pass through the ball contacting surface 16, thereby ensuring that an unbalance type force is not applied to the ball contacting surface 16 (e.g., such as that caused by a large drag on one portion of the golf ball contacting portion 16 where sand 72 does not readily pass and a relatively small drag on a second portion of the ball contacting surface 16 where sand readily passes through). Further, as shown best in FIG. 2, the "back side" or "non-golf ball contacting side" 7 of the surface 16 need not be finished or have a substantially identical texture as portion 17.

Alternatively, it should be understood that the "face" of the club 10 includes several bridge portions, each of which lie between portions 30 and the bottom portion 9. Thus, these bridge portions and the bottom portion 9 cooperatively and entirely define the club face.

Figure 5:
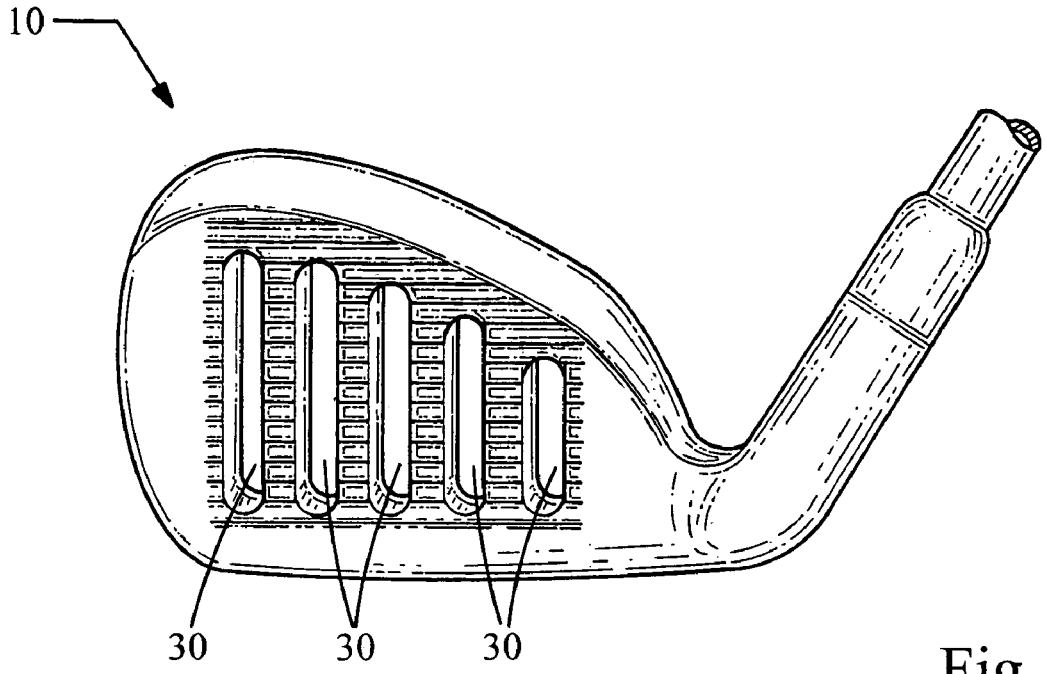
FIG. 5 is a partial front view of a golf club which is made in accordance with the teachings of an alternate embodiment of the invention.
Figure 6:
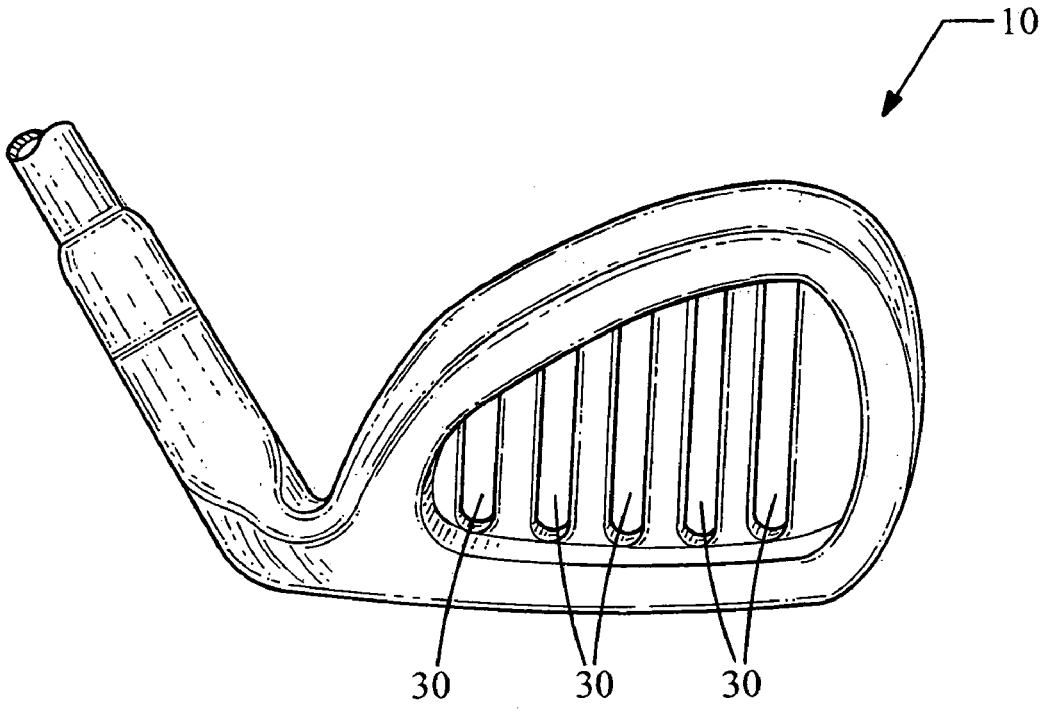
FIG. 6 is a partial back view of the golf club which is shown in FIG. 3.

As shown best in FIGS. 5 and 6, in an alternate embodiment of the invention, the openings 30 are only formed within and wholly terminate within the body the ball contacting portion or surface 16.

It is to be understood that the inventions are not limited to the exact construction and method which has been illustrated above, but that various changes and modifications may be made without departing from the spirit and the scope of the inventions as are more fully delineated, in a non-limiting manner, within the claims.

What is claimed is:

1. A golf club comprising a handle portion; and a golf ball contacting portion which is attached to said handle portion, and wherein said golf ball contacting portion includes a heel portion and an end portion, and wherein said golf ball contacting portion includes a plurality of slots, each of said plurality of slots having a longitudinal axis of symmetry, and an identical width and a respective length which is dependent upon its respective location within said golf ball contacting portion, such that the length of the slot which is closest to said heel portion has a length which is shorter than the length of any of said other slots and such that the length of the slot which is closest to said end portion has a length which is longer than the length of any of said other slots and wherein said respective length of each of said slots is longer than the length of other slots which are closer to said heel portion but is shorter than the length of each of said remaining slots which are closer to said end portion, and wherein each of said slots pass through a first top edge of said golf ball contacting portion and terminate within a second lower portion of said golf ball contacting portion above said heel portion, and wherein each of said slots is formed and bounded by a first semicircular surface which is formed in said second lower portion and a pair of substantially identical flat surfaces which respectively terminate into said first semicircular surface, and wherein each unique pair of substantially identical flat surfaces extend in the direction of a user of said club, are respectively and linearly coextensive to a unique slot, are parallel to each other and to said longitudinal axis of symmetry of said unique slot, and form two opposed flat, linearly coextensive and parallel slot surfaces, thereby causing each of said slots to have an identical cross-sectional area and wherein said handle is separated from all of said slots by a portion of said golf ball contacting portion.

* * * * *